US010123137B2

(12) United States Patent
Chang et al.

(10) Patent No.: US 10,123,137 B2
(45) Date of Patent: Nov. 6, 2018

(54) WEARABLE ACOUSTIC DEVICE WITH MICROPHONE

(71) Applicant: Samsung Electronics Co., Ltd., Gyeonggi-do (KR)

(72) Inventors: Juhee Chang, Gyeonggi-do (KR); Je-Ok Lee, Gyeonggi-do (KR); Taiyong Kim, Seoul (KR); Sukhyun Lee, Gyeonggi-do (KR); Byoung-Hee Lee, Seoul (KR); Seonmi Kim, Gyeonggi-do (KR); Sangju Lee, Gyeonggi-do (KR); Ho-Chul Hwang, Gyeonggi-do (KR)

(73) Assignee: Samsung Electonics Co., Ltd (KR)

( * ) Notice: Subject to any disclaimer, the term of this patent is extended or adjusted under 35 U.S.C. 154(b) by 0 days.

(21) Appl. No.: 15/439,519

(22) Filed: Feb. 22, 2017

(65) Prior Publication Data

US 2017/0318401 A1 Nov. 2, 2017

(30) Foreign Application Priority Data

Apr. 29, 2016 (KR) ..... 10-2016-0052874

(51) Int. Cl.
*H04R 25/00* (2006.01)
*H04R 1/10* (2006.01)

(52) U.S. Cl.
CPC ..... *H04R 25/604* (2013.01); *H04R 1/1075* (2013.01); *H04R 25/652* (2013.01); *H04R 1/1016* (2013.01); *H04R 25/45* (2013.01); *H04R 2201/003* (2013.01); *H04R 2201/105* (2013.01); *H04R 2225/025* (2013.01); *H04R 2460/01* (2013.01)

(58) Field of Classification Search
CPC .. H04R 25/606; H04R 25/604; H04R 25/652; H04R 2201/003; H04R 2225/025
USPC ..... 381/324
See application file for complete search history.

(56) References Cited

U.S. PATENT DOCUMENTS 4,985,925 A * 1/1991 Langberg ..... G10K 11/178 381/71.6
8,682,001 B2 3/2014 Annunziato et al.
2012/0087521 A1* 4/2012 Delaus ..... B81C 1/00238 381/174
2013/0343592 A1 12/2013 Schmidt et al.
2016/0157012 A1* 6/2016 Yoo ..... H04R 1/20 381/369

OTHER PUBLICATIONS

In-Ear Noise Cancelling Headphones with Mic http:www.sony.com/en-jo/electronics/in-ear-headphones/mdr-ex750na Copyright 2016 Sony Middle East and Africa FZE, pp. 12.

* cited by examiner

*Primary Examiner* — Sunita Joshi
(74) *Attorney, Agent, or Firm* — The Farrell Law Firm, P.C.

(57) ABSTRACT

A wearable acoustic device with a microphone is provided. The wearable acoustic device includes a first housing forming a first acoustic emission path, a second housing combined with the first housing in a first direction that is substantially parallel to the first acoustic emission path, an acoustic component part arranged within the second housing and emitting sound through the first acoustic emission path, and at least one microphone arranged adjacent to the first acoustic emission path within the first housing.

13 Claims, 20 Drawing Sheets

WEARABLE ACOUSTIC DEVICE WITH MICROPHONE

PRIORITY

This application claims priority under 35 U.S.C. § 119(a) to a Korean Patent Application filed in the Korean Intellectual Property Office on Apr. 29, 2016 and assigned Serial No. 10-2016-0052874, the contents of which are incorporated herein by reference.

BACKGROUND

1. Field of the Disclosure

The present disclosure generally relates to a wearable acoustic device with a microphone, and more particularly, to a wearable acoustic device that is worn on an ear.

2. Description of the Related Art

Commonly, a sound related electronic device provides a hearing sense function, and the sound related electronic device can be worn near an ear. For example, the sound related electronic device can be a type of device (i.e., wearable device) for being worn on the ear. The sound related electronic device can be mounted for use with at least one or more sound related components. An acoustic component can include a speaker, a microphone, a receiver, etc., for example. These acoustic components can be mounted in various structures.

However, such an electronic device can be disadvantageous to design miniaturization because of the need for an additional space for mounting the acoustic components in a restricted internal space of a small sized device. Also, the electronic device can cause deterioration of a sound quality due to a mounting structure of the acoustic component as well.

SUMMARY

An aspect of the present provides for mounting an acoustic component without increasing the entire size within a restricted mounting space of a small sized wearable acoustic device such as an earphone.

Another aspect of the present disclosure provides a wearable acoustic device for improving acoustic performance by securing an acoustic path.

Another aspect of the present disclosure provides a wearable acoustic device capable of mounting a microphone for noise cancellation without an additional space.

In accordance with an aspect of the present disclosure, a wearable acoustic device includes a first housing forming a first acoustic emission path, a second housing combined with the first housing in a first direction that is substantially parallel to the first acoustic emission path, an acoustic component part arranged within the second housing and emitting sound through the first acoustic emission path, and at least one microphone arranged adjacent to the first acoustic emission path within the first housing.

In accordance with an aspect of the present disclosure, a wearable acoustic device includes a nozzle forming a first acoustic emission path, a housing combined with the nozzle in a first direction that is substantially parallel to the first acoustic emission path, a speaker arranged within the housing and emitting sound through the first acoustic emission path, and a microphone arranged adjacent to the first acoustic emission path within the housing.

BRIEF DESCRIPTION OF THE DRAWINGS

The above and other aspects, features, and advantages of certain embodiments of the present disclosure will be more apparent from the following detailed description taken in conjunction with the accompanying drawings, in which.

DETAILED DESCRIPTION

Figure 1B:
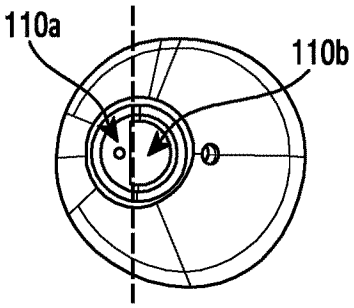
FIG. 1B illustrates a plan view illustrating the wearable acoustic device according to an embodiment of the present disclosure.

Hereinafter, various embodiments of the present disclosure will be described with reference to the accompanying drawings. However, it should be understood that there is no intent to limit the present disclosure to the particular forms disclosed herein; rather, 20 the present disclosure should be construed to cover various modifications, equivalents, and/or alternatives of embodiments of the present disclosure. In describing the drawings, similar reference numerals may be used to designate similar constituent elements.

As used herein, the expressions "have", "may have", "include", or "may include" refer to the existence of a corresponding feature (e.g., numeral, function, operation, or constituent element such as component), and do not exclude one or more additional features.

In the present disclosure, the expressions "A or B", "at least one of A or/and B", or "one or more of A or/and B" may include all possible combinations of the items listed. For example, the expressions "A or B", "at least one of A and B", or "at least one of A or B" refer to all of (1) including at least one A, (2) including at least one B, or (3) including all of at least one A and at least one B.

The expressions such as "first", "second", or the like used in various embodiments of the present disclosure may modify various elements regardless of order or importance, and do not limit corresponding elements. The above-described expressions may be used to distinguish an element from another element. For example, a first user device and a second user device indicate different user devices although both of them are user devices. For example, a first element may be referred to as a second element, and similarly, a second element may be referred to as a first element without departing from the scope of the present disclosure.

It should be understood that when an element (e.g., first element) is referred to as being (operatively or communicatively) "connected," or "coupled," to another element (e.g., second element), it may be directly connected or coupled directly to the other element or any other element (e.g., third element) may be interposer between them. In contrast, it may be understood that when an element (e.g., first element) is referred to as being "directly connected," or "directly coupled" to another element (second element), there are no element (e.g., third element) interposed between them.

The expression "configured to" used in the present disclosure may be used interchangeably with, for example, "suitable for", "having the capacity to", "designed to", "adapted to", "made to", or "capable of" according to the situation. The expression "configured to" may not necessarily mean "specially designed to" in terms of hardware. Alternatively, in some situations, the expression "device configured to" may mean that the device, together with other devices or components, "is able to". For example, the phrase "processor adapted (or configured) to perform A, B, and C" may mean a dedicated processor (e.g., embedded processor) only for performing the corresponding operations or a generic-purpose processor (e.g., central processing unit (CPU) or application processor (AP)) that can perform the corresponding operations by executing one or more software programs stored in a memory device.

The terms used herein are merely for the purpose of describing particular embodiments and are not intended to limit the scope of other embodiments. As used herein, singular forms may include plural forms as well unless the context clearly indicates otherwise. Unless defined otherwise, all terms used herein, including technical terms and scientific terms, may have the same meaning as commonly understood by a person of ordinary skill in the art to which the present disclosure pertains. Terms, such as those defined in commonly used dictionaries, should be interpreted as having a meaning that is the same or similar to their meaning in the context of the relevant art and will not be interpreted in an idealized or overly formal sense unless expressly so defined herein. In some cases, even a term defined in the present disclosure should not be interpreted to exclude embodiments of the present disclosure.

Hereinafter, various embodiments of the present disclosure will be described with reference to the accompanying drawings.

A construction of a wearable acoustic device according to the present disclosure will be described below in detail with reference to the accompanying drawings. In the respective drawings, a rectangular coordinate system can be used. In the drawing, a Y axis can mean a first direction, and an X axis can mean a second direction.

Figure 1A:
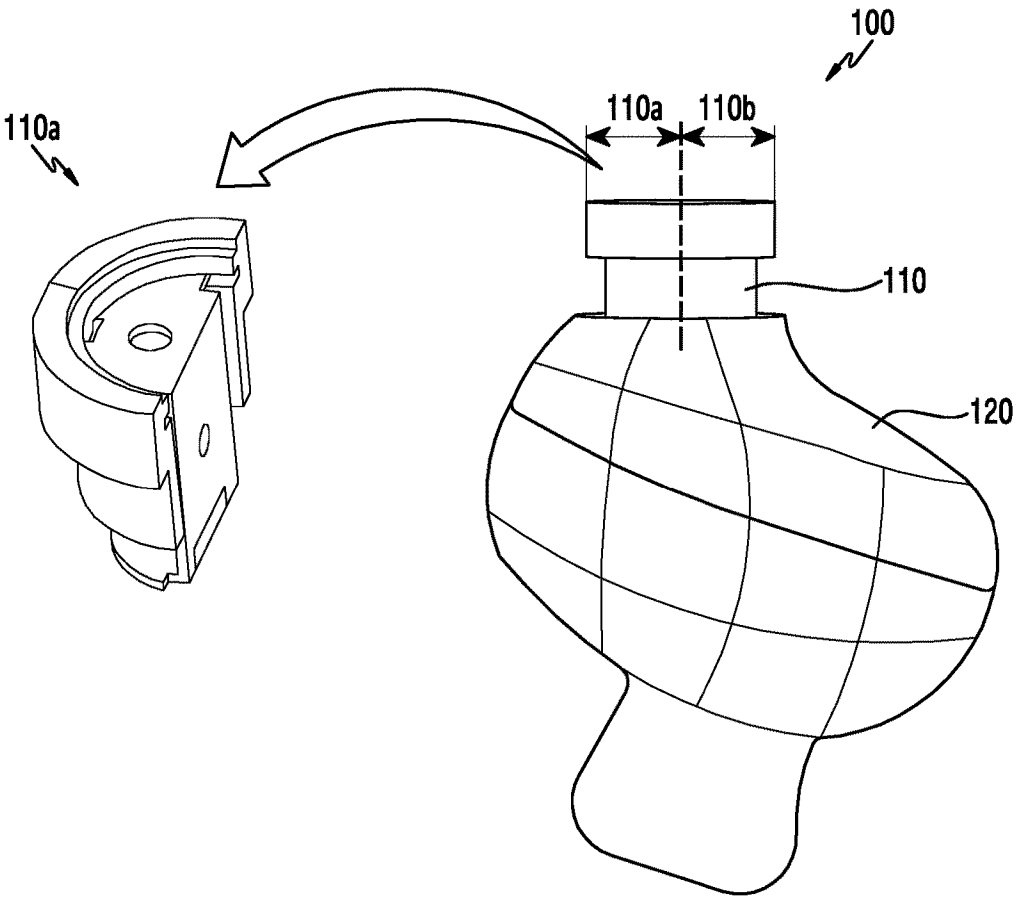
FIG. 1A is a side view and detailed perspective view illustrating a wearable acoustic device according to an embodiment of the present disclosure.
Figure 2:
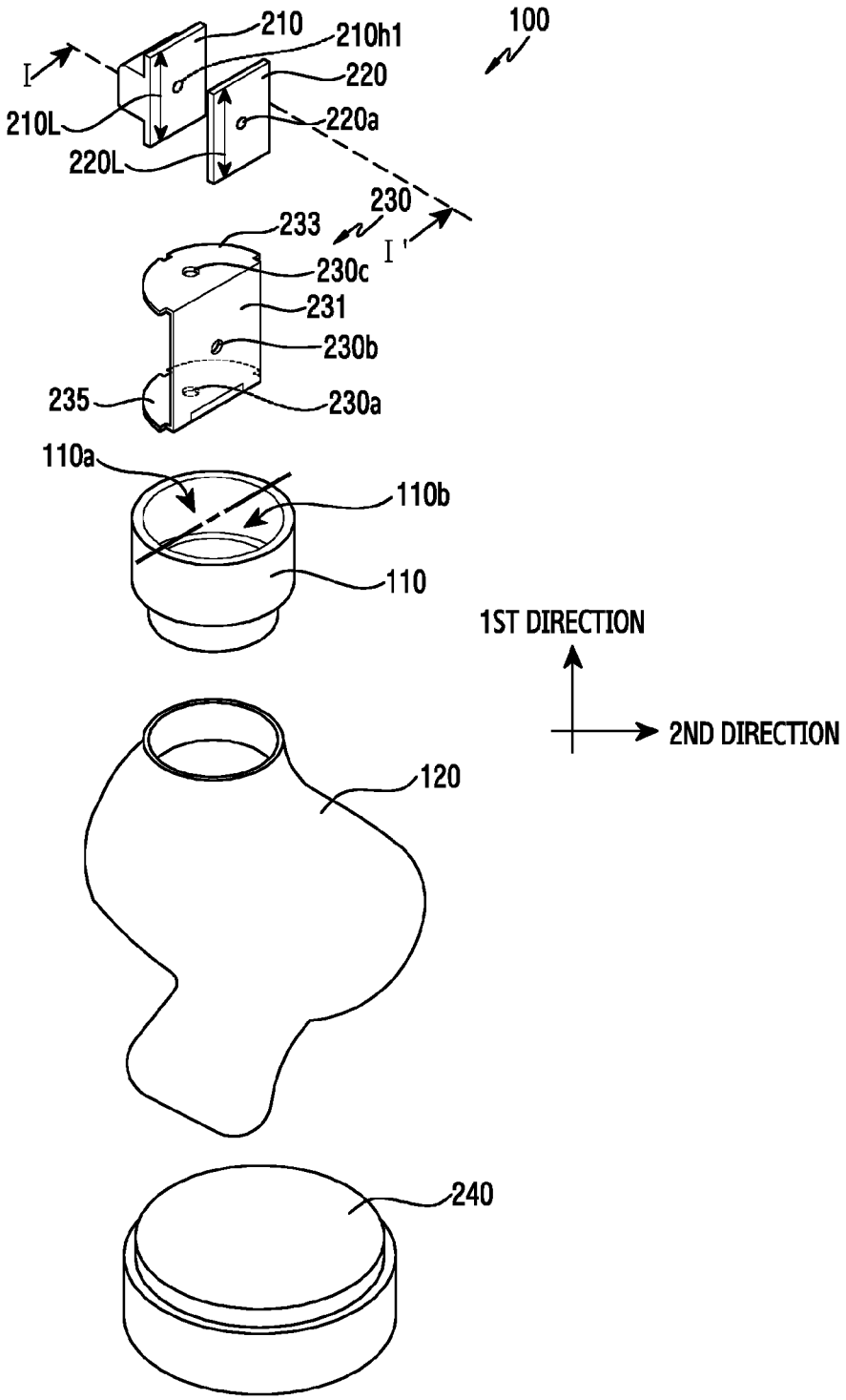
FIG. 2 is an exploded perspective view illustrating a wearable acoustic device according to an embodiment of the present disclosure.

FIG. 1A is a side view and detailed perspective view illustrating a wearable acoustic device according to an embodiment of the present disclosure. FIG. 1B is a plan view illustrating the wearable acoustic device according to an embodiment of the present disclosure. FIG. 2 is an exploded perspective view illustrating the wearable acoustic device according to an embodiments of the present disclosure.

Referring to FIG. 1 and FIG. 2, the wearable acoustic device 100 is a wearable device worn on a human body. For example, the wearable acoustic device 100 is an electronic device for a hearing sense related to sound. The wearable acoustic device 100 can be a small sized wearable device including a headphone that is worn on an ear, a headset, an ear set, an earphone, a hearing aid, an ear type headset, an earbud, etc. Particularly, the wearable device 100 according to an embodiment of the present disclosure can be a miniaturized wearable device that can be worn on the ear by an ear mold having elasticity and size to be worn in the inner ear.

The wearable acoustic device 100 includes at least one or more housings 110 and/or 120, a microphone 210, a circuit substrate 220, an acoustic component part 240, 15 etc.

The housing 110 and/or 120 can include a first housing 110 and a second housing 120. The first housing 110 can be a nozzle forming a path emitting sound from the acoustic component part 240. The first housing 110 is insertable into the inner ear (i.e., 20 internal ear). Although not illustrated in the drawing, an ear mold can be further combined to the first housing 110 and be wearable in the inner ear. The first housing 110 can have a size and shape of being insertable into the internal ear. The first housing 110 can be of a hollow cylindrical shape.

The first housing 110 can include a microphone mounting part 110a and a first acoustic emission path 110*b*.

The microphone mounting part 110*a* can be formed to secure the first acoustic emission path 110*b*. The microphone mounting part 110*a* can mount the microphone 210, and the circuit substrate 220. That is, at least one or more microphones 210, circuit substrates 220, etc. can be mounted in at least one part of the first housing 110.

The microphone 210 can be arranged in consideration of a size of the first housing 110. The microphone 210 can be arranged to secure an acoustic emission path in the first housing 110. That is, the microphone 210 can be arranged to secure the first acoustic emission path 110*b*. The microphone 210 can be arranged adjacent to the first acoustic emission path 110*b*. For example, a part 210L having a greater length in the microphone 210 can be arranged along a first direction that is a length direction of the first housing 110. Where a length or width of the part 210L is greater than a width or inner diameter of the first housing 110, the part 210L can be arranged in a first direction. That is, an upper surface of the microphone 210 can be arranged to face an inner surface of the first housing 110. But, the present disclosure is not limited to this, and where the length or width of the part 210L is less than the width or inner diameter of the first housing 110, the part 210L can be arranged in a second direction. That is, the upper surface of the microphone 210 can be arranged to face an upper part or lower part of the first housing 110.

Similarly, a part 220L having a greater length in the circuit substrate 220 mounted 20 with the microphone 210 can be arranged along the first direction in the first housing 110.

That is, where a length or width of the part 220L is greater than a width or inner diameter of the first housing 110, the part 220L can be arranged in the first direction. That is, an upper surface of the circuit substrate 220 can be arranged to face an inner surface of the first housing 110. But the present disclosure is not limited to this, and where the length or 25 width of the part 220L is less than the width or inner diameter of the first housing 110, the part 220L can be arranged in the second direction. That is, the upper surface of the circuit substrate 220 can be arranged to face an upper part or lower part of the first housing 110.

The microphone 210 can be a microphone for noise cancellation. The microphone 210 can be a feedback (FB) microphone for active noise cancellation (ANC) for collecting noises within the wearable acoustic device 100. For example, the microphone 210 can include various kinds of microphones such as an electronic condenser microphone (ECM), a micro electro mechanical system (MEMS), etc. Also, the microphone 210 can include a bottom type microphone in which a microphone hole 210*h*1 is designed in the bottom. In FIG. 2, the bottom type microphone in which the microphone hole 210*h*1 is provided in the bottom is illustrated. But the present disclosure is not limited to this, and the microphone 210 can be a top type microphone in which a microphone hole is designed in a top surface as well. Also, the present disclosure is not limited to this, and the microphone 210 can be various kinds of microphones capable of collecting sound.

The circuit substrate 220 is electrically connected with the microphone 210. The circuit substrate 220 forwards an electrical signal to the microphone 210. Alternatively, the circuit substrate 220 can forward an electrical signal of the microphone 210 to other components of the wearable acoustic device 100. For example, the circuit substrate 220 can forward an electrical signal of the microphone 210 to the acoustic component part 240. The circuit substrate 220 can include a soldering terminal for signal connection. At this time, the circuit substrate 220 can include various kinds of substrates such as a printed circuit board (PCB), a flexible printed circuit board (FPCB), etc. The wearable acoustic device 100 can further have a cable for making a physical connection between the circuit substrate 220 and the acoustic component part 240. The cable can be of an FPCB or wire form. Alternatively, though not illustrated in the drawing, by substituting the circuit substrate 220, only a cable of a wire form can be provided as well.

A fixing part 230 can be further arranged in the microphone mounting part 110*a* and fix the microphone 210 and the circuit substrate 220. The fixing part 230 can be separately provided in the microphone mounting part 110*a*, and installed within the first housing 110. The fixing part 230 can be, for example, a Steel Use Stainless (SUS), etc. The fixing part 230 fixes the microphone 210 and the circuit substrate 220. The fixing part 230 can be constructed of various materials having hardness and strength capable of safely mounting the fixing part 230 in the first housing 110. The fixing part 230 can include a safe mounting part 231 capable of safely mounting the circuit substrate 220 mounted with the microphone 210. Also, the fixing part 230 can include at least any one of a first combination part 233 and a second combination part 235 that extend from the safe mounting part 231 such that the fixing part 230 can be combined to the first housing 110. The fixing part 230 can include at least one first opening part 230*a*, a second opening part 230*b*, and a third opening part 230*c*. In FIG. 2, it is illustrated that the fixing part 230 includes all of the first opening part 230*a*, the second opening part 230*b*, and the third opening part 230*c*. But the present disclosure is not limited to this, and the fixing part 230 can include one or more opening parts among these. Through the opening parts 230*a*, 230*b*, and 230*c*, the performance of the microphone 210 can be secured, and the acoustic performance of the wearable acoustic device 100 can be secured. This will be described later in detail.

The first acoustic emission path 110*b* can be arranged adjacent to the microphone mounting part 110*a*. That is, at least one part of the first housing 110 can form the acoustic emission path. The first acoustic emission path 110*b* can be formed along the first direction. The first acoustic emission path 110*b* forms the remaining part excluding the microphone mounting part 110*a* in the first housing 110. The first acoustic emission path 110*b* can be a path that sound emitted from a speaker of the acoustic component part 240 flows through.

The second housing 120 can be combined with the first housing 110 in the first direction. That is, the second housing 120 can be combined in the first direction to be substantially parallel to the first acoustic emission path 110*b*. The second housing 120 can be assembled with the first housing 110 by ultrasonic welding. While in FIGS. 1 and 2, the second housing 120 is shown to be comprised of one body, the present disclosure is not limited to this, and the second housing 120 can be a combined structure of housings having various forms and pieces.

The acoustic component part 240 can be mounted within the second housing 120. The acoustic component part 240 can include various acoustic components, a speaker, a sensor, a battery, and a button, etc. The acoustic component part 240 can emit sound through the first acoustic emission path 110*b*. This acoustic component part 240 can be fixed by a support member, etc.

Figure 3A:
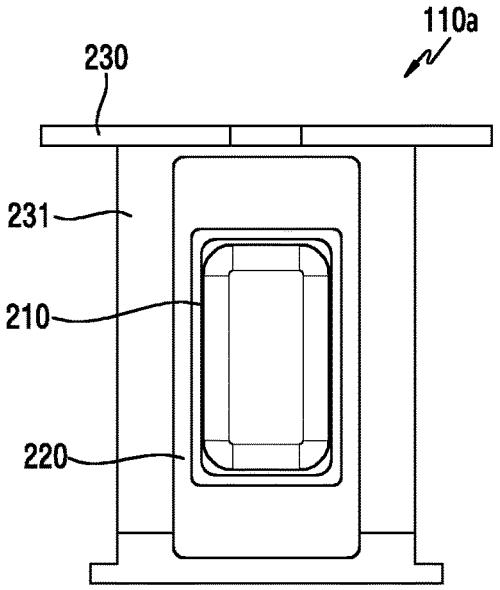
FIG. 3A is a plan view illustrating one surface of a fixing part on which a microphone and a circuit substrate are mounted, in a wearable acoustic device according to an embodiment of the present disclosure.
Figure 3B:
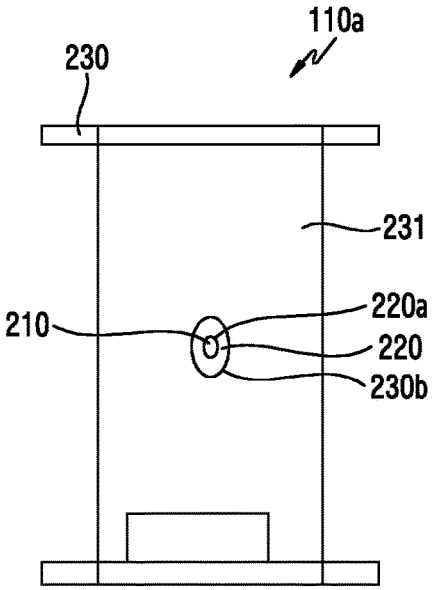
FIG. 3B is a plan view illustrating the other surface of the fixing part on which the microphone and the circuit substrate are mounted, in the wearable acoustic device according to an embodiment of the present disclosure.

FIG. 3A is a plan view illustrating one surface of a fixing part on which a microphone and a circuit substrate are mounted, in a wearable acoustic device according to an embodiment of the present disclosure. FIG. 3B is a plan view illustrating the other surface of the fixing part on which the microphone and the circuit substrate are mounted, in the wearable acoustic device according to an embodiment of the present disclosure.

As illustrated in FIG. 3A, the microphone 210 and the circuit substrate 220 can be mounted on any one surface of the safe mounting part 231 in the fixing part 230. That is, the circuit substrate 220 mounted with the microphone 210 can be assembled to any surface of the safe mounting part 231. For example, the circuit substrate 220 mounted with the microphone 210 can be fixed to the safe mounting part 231 by an adhesive layer (510 of FIG. 5). That is, in various exemplary embodiments, the adhesive layer can be further provided between the safe mounting part 231 of the fixing part 230 and the circuit substrate 220. The adhesive layer can be a double-sided tape.

As illustrated in FIG. 3B, at least one part of the microphone 210 can be exposed through the second opening part 230*b* of the safe mounting part 231. For example, a microphone hole of the microphone 210 can be exposed through the second opening part 230*b*. The circuit substrate 220 can further include a fourth opening part 220*a* corresponding to the second opening part 230*b*. One part of the microphone 210 can be exposed to the second opening part 230*b* and the fourth opening part 220*a*. That is, the microphone hole of the microphone 210 can be exposed through the second opening part 230*b* and the fourth opening part 220*a*.

Figure 4B:
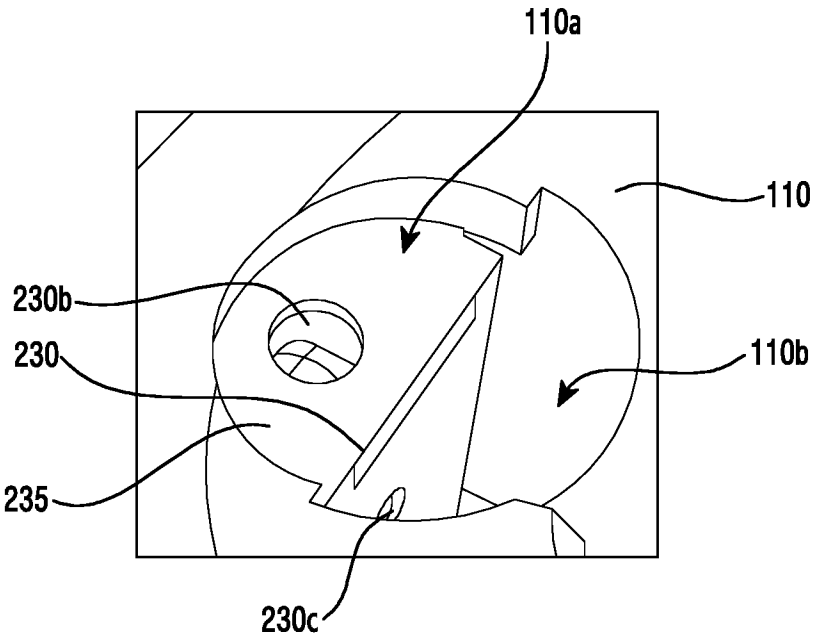
FIG. 4B is a perspective view illustrating a lower end at which the fixing part and the first housing are combined.
Figure 4A:
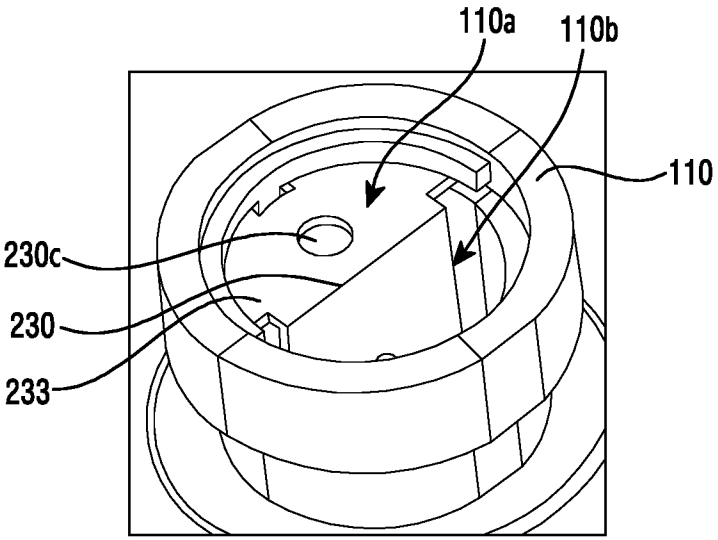
FIG. 4A is a perspective view illustrating an upper end at which a fixing part and a first housing are combined.

FIG. 4A is a perspective view illustrating an upper end at which a fixing part and a first housing are combined. FIG. 4B is a perspective view illustrating a lower end at which the fixing part and the first housing are combined.

As illustrated in FIG. 4A, the first combination part 233 of the fixing part 230 and the first housing 110 can be combined to each other in various manners. For example, an inner surface of the first housing 110 can include a step. The first combination part 233 can be mounted on the step of the first housing 110. That is, the inner surface of the first housing 110 can include a step, a recess, an assembly groove, etc. such that the first combination part 233 of the fixing part 230 can be combined. But the present disclosure is not limited to this, and the first housing 110 and the fixing part 230 can be combined with each other through various combination structures.

As illustrated in FIG. 4B, the second combination part 235 of the fixing part 230 and the first housing 110 can be combined to each other in various manners. For example, the inner surface of the first housing 110 can include a step, and the step of the first housing 110 and the second combination part 235 can be mutually combined. That is, the first housing 110 can include a step, a recess, an assembly groove, etc. such that the first combination part 233 of the fixing part 230 can be mounted on the inner surface of the first housing 110. After the fixing part 230 is mounted in the first housing 110, the first housing 110 and the second housing 120 can be assembled by ultrasonic welding, etc.

Figure 5:
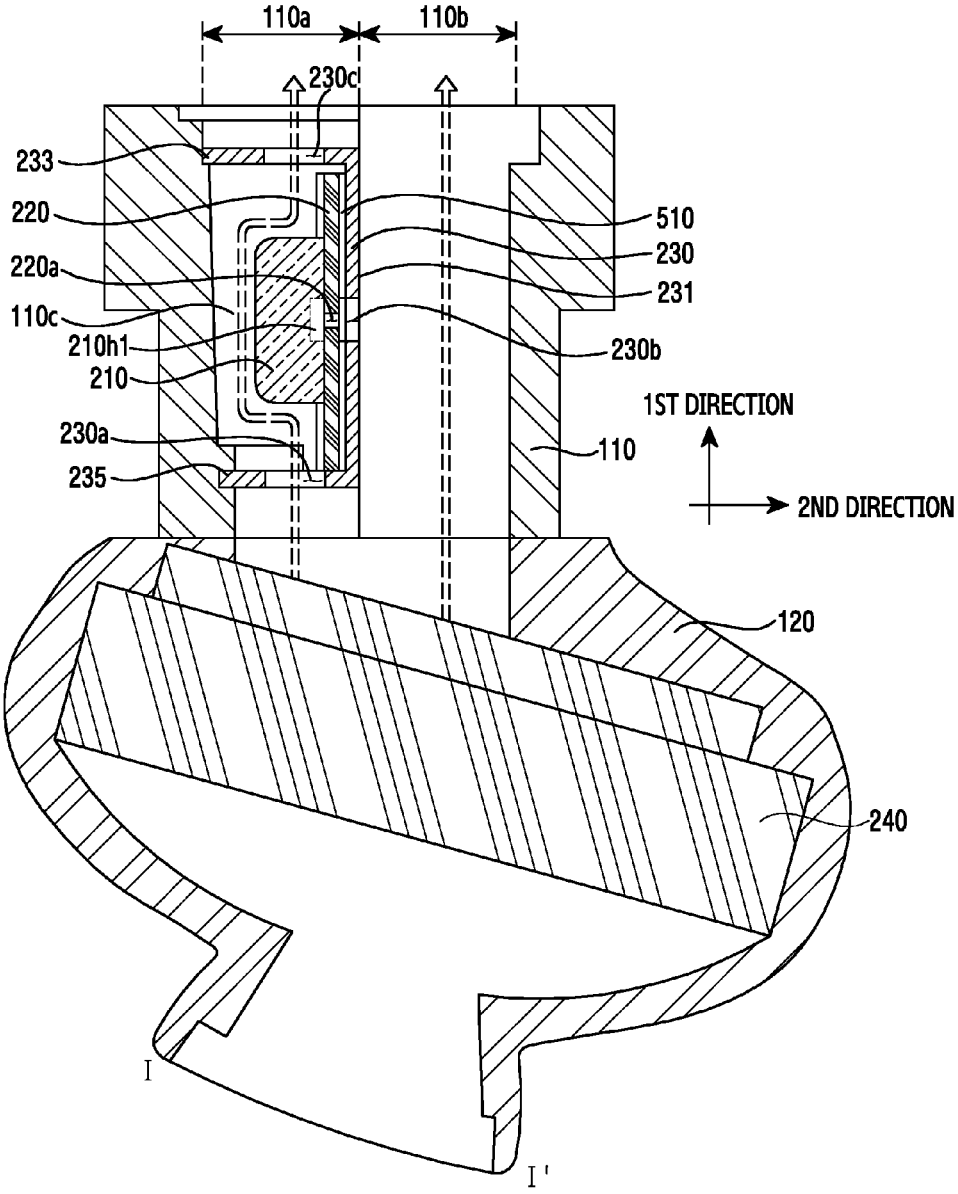
FIG. 5 is a section taken along line I-I' of FIG. 2 of the assembled wearable acoustic device.

FIG. 5 is a section taken along line I-I' of FIG. 2 of the assembled wearable acoustic device.

As illustrated in FIG. 5, the first housing 110 includes the microphone mounting part 110*a* and the first acoustic emission path 110*b*. The microphone mounting part 110*a* can include the fixing part 230 capable of fixing the microphone 210, the circuit substrate 220, etc. The microphone 210 can be arranged to secure the first acoustic emission path 110*b*.

In the wearable acoustic device according to an embodiment of the present disclosure, the fixing part 230 can include the first opening part 230*a*, the second opening part 230*b*, and the third opening part 230*c*.

In the fixing part 230, the first opening part 230*a* can be arranged between the circuit substrate 220 and the acoustic component part 240 of FIG. 2. The first opening part 230*a* can be opened in the first direction. The first opening part 230*a* can be arranged in a lower surface of the fixing part 230. The first opening part 230*a* can be positioned in the second combination part 235. The circuit substrate 220 and the acoustic component part 240 can be physically connected through the first opening part 230*a*. For example, a wire for connection between the circuit substrate 220 and the acoustic component part 240 can pass through the first opening part 230*a*.

In the fixing part 230, the second opening part 230*b* can be arranged between the microphone 210 and the first acoustic emission path 110*b*. The second opening part 230*b* can be opened in the second direction crossing with the first direction. The second opening part 230*b* can be positioned in the safe mounting part 231 of the fixing part 230. The microphone 210 can collect sound through the second opening part 230*b*. For example, where the microphone 210 is a bottom type microphone 210 in which the microphone hole 210*h*1 is designed in the bottom, sound emitted to the first acoustic emission path 110*b* can be forwarded to the microphone 210 through the second opening part 230*b*. Where the microphone 210 is the bottom type microphone 210, the circuit substrate 220 can further include a fourth opening part 220*a* corresponding to the second opening part 230*b*. That is, sound emitted through the first acoustic emission path 11*b* can pass through the second opening part 230*b* and the fourth opening part 220*a* and be collected to the microphone hole 210*h*1 of the microphone 210.

The third opening part 230*c* can be arranged to face the first opening part 230*a*. The third opening part 230*c* can be arranged in a position opposite the first opening part 230*a* centering on the microphone 210, and can be opened in the first direction. That is, in the fixing part 230, the first opening part 230*a* and the third opening part 230*c* can be arranged along the first direction. The third opening part 230*c* can be arranged in an upper surface of the fixing part 230. The third opening part 230*c* can be arranged in the first combination part 233.

The third opening part 230*c* can form a second acoustic emission path 110*c*. That is, the first opening part 230*a* and the third opening part 230*c* can form an additional acoustic path besides the first acoustic emission path 110*b*. The first opening part 230*a* and the third opening part 230*c* can secure the path emitting sound even within the microphone mounting part 110*a*. Accordingly, by further securing the path that sound emitted from a speaker of the acoustic component part 240 flows through, the acoustic performance of the wearable acoustic device 100 can be improved.

Figure 6:
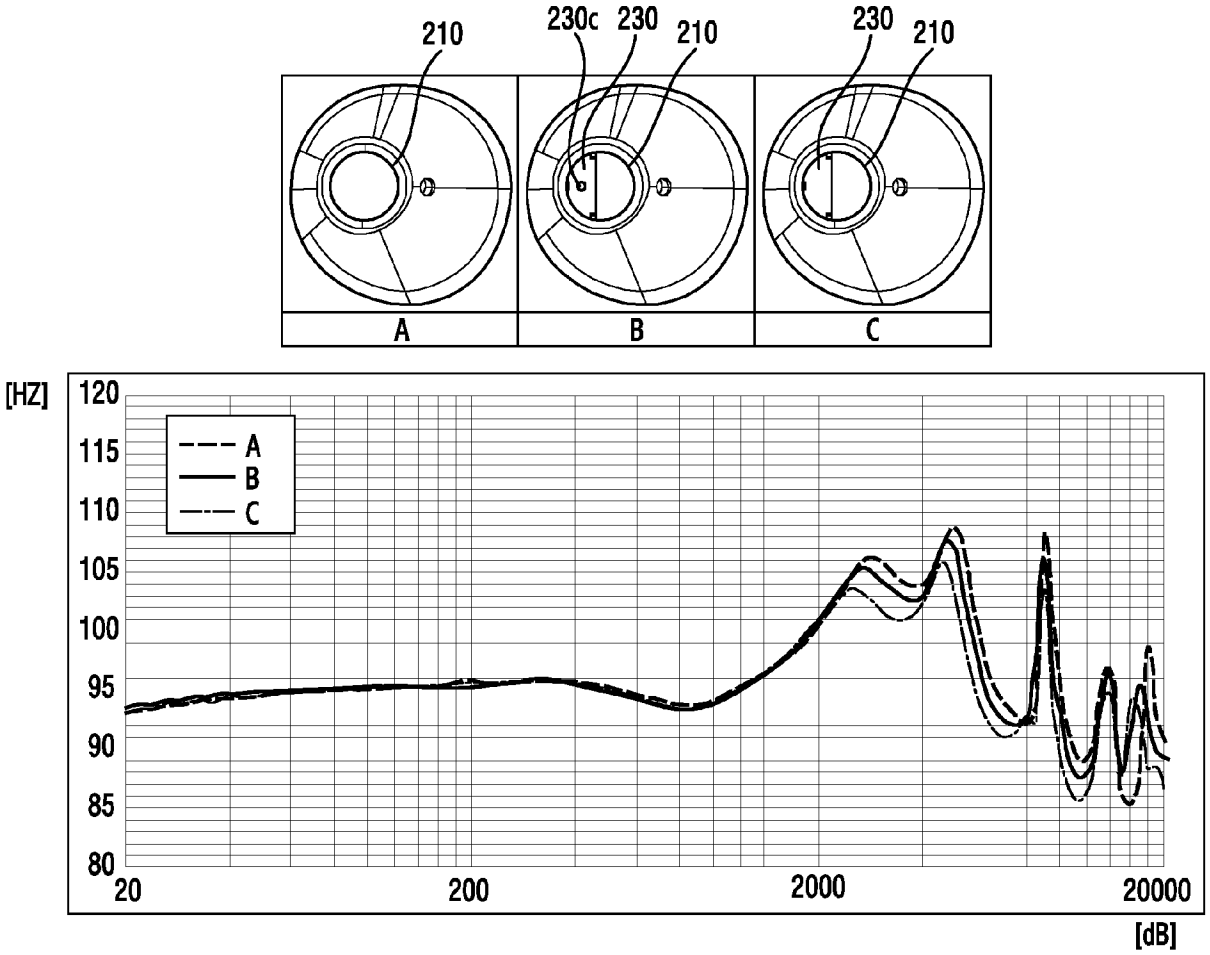
FIG. 6 is a graph representing acoustic performance dependent on the existence or non-existence of an opening part in a fixing part of a wearable acoustic device according to an embodiment of the present disclosure.

FIG. 6 is a graph representing acoustic performance dependent on the existence or non-existence of an opening part in a fixing part of a wearable acoustic device according to an embodiment of the present disclosure. FIG. 6 is a graph measuring a sound pressure 1 (SPL) in accordance with each embodiment of the present disclosure.

Embodiment A is an embodiment in which the fixing part 230 is not provided in the first housing 210. Embodiment B is an embodiment in which the fixing part 230 is provided in the first housing 210, and the third opening part 230*c* is provided in the fixing part 230. Embodiment C is an exemplary embodiment in which the fixing part 230 is provided in the first housing 210, and the third opening part 230*c* is not provided in the fixing part 230. As illustrated in FIG. 6, it can be determined that a difference of an acoustic characteristic or frequency characteristic between embodiment B and embodiment A is not great. Also, it can be determined that embodiment B has an excellent acoustic characteristic or frequency characteristic compared to embodiment C in which the third opening part 230*c* is not provided in the fixing part 230.

Figure 7:
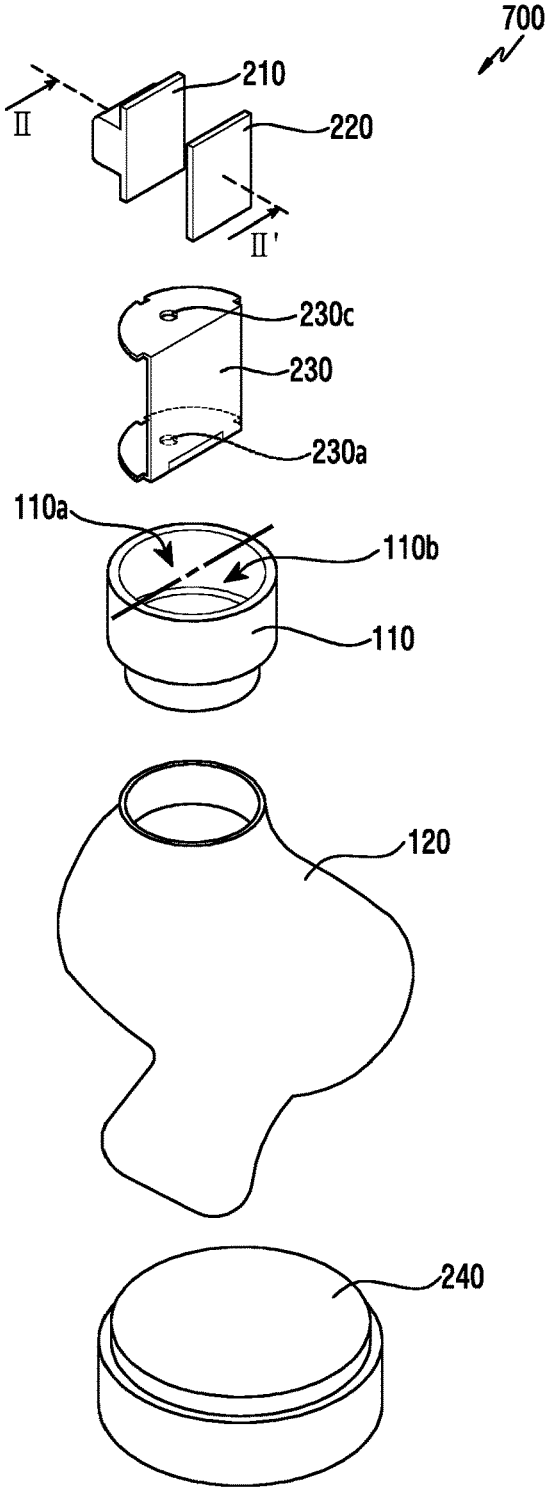
FIG. 7 is an exploded perspective view illustrating a wearable acoustic device according to an embodiment of the present disclosure.
Figure 8:
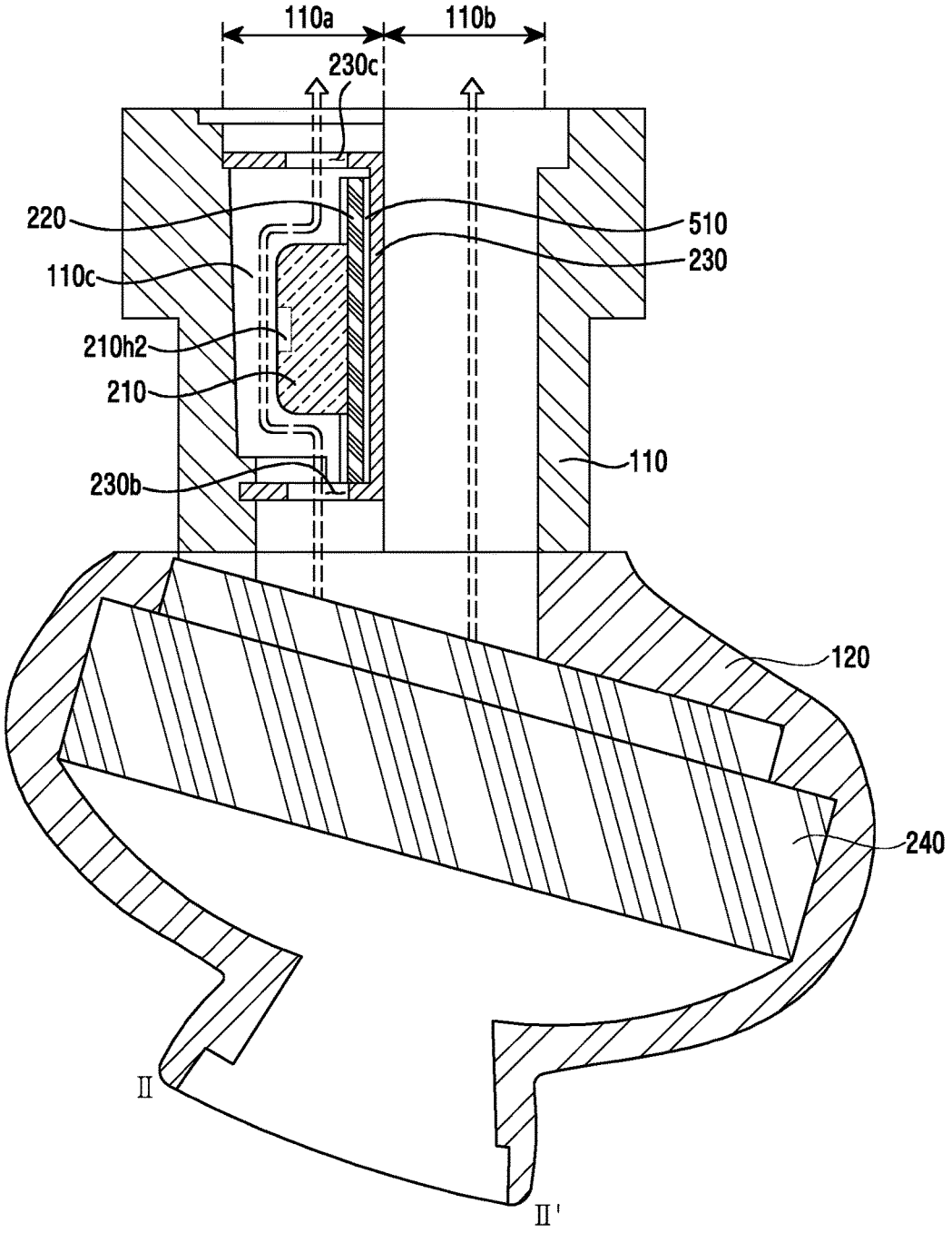
FIG. 8 is a section taken along line II-II' of FIG. 7 of the assembled wearable acoustic device.

FIG. 7 is an exploded perspective view illustrating a wearable acoustic device according to an embodiment of the present disclosure. FIG. 8 is a section of a first housing taken along line II-II' of FIG. 7 of the assembled wearable acoustic device.

As illustrated in FIG. 7 and FIG. 8, in the wearable acoustic device 700, the microphone 210 can be a top type microphone in which a microphone hole 210*h*2 is provided in a top surface. At this time, the fixing part 230 can include the first opening part 230*a* and the third opening part 230*c*. The top surface of the microphone 210 can be arranged to face the second acoustic emission path 110*c*, so the microphone hole 210*h*2 faces the second acoustic emission path 110*c*. The microphone hole 210*h*2 of the microphone 210 can collect sound through the second acoustic emission path 110*c*. That is, the second opening part 230*b* of the fixing part 230 can be omitted in the wearable acoustic device 100 earlier illustrated in FIG. 2.

Figure 9B:
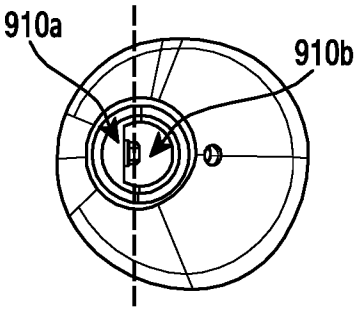
FIG. 9B is a plan view illustrating the wearable acoustic device according to an embodiment of the present disclosure.
Figure 9A:
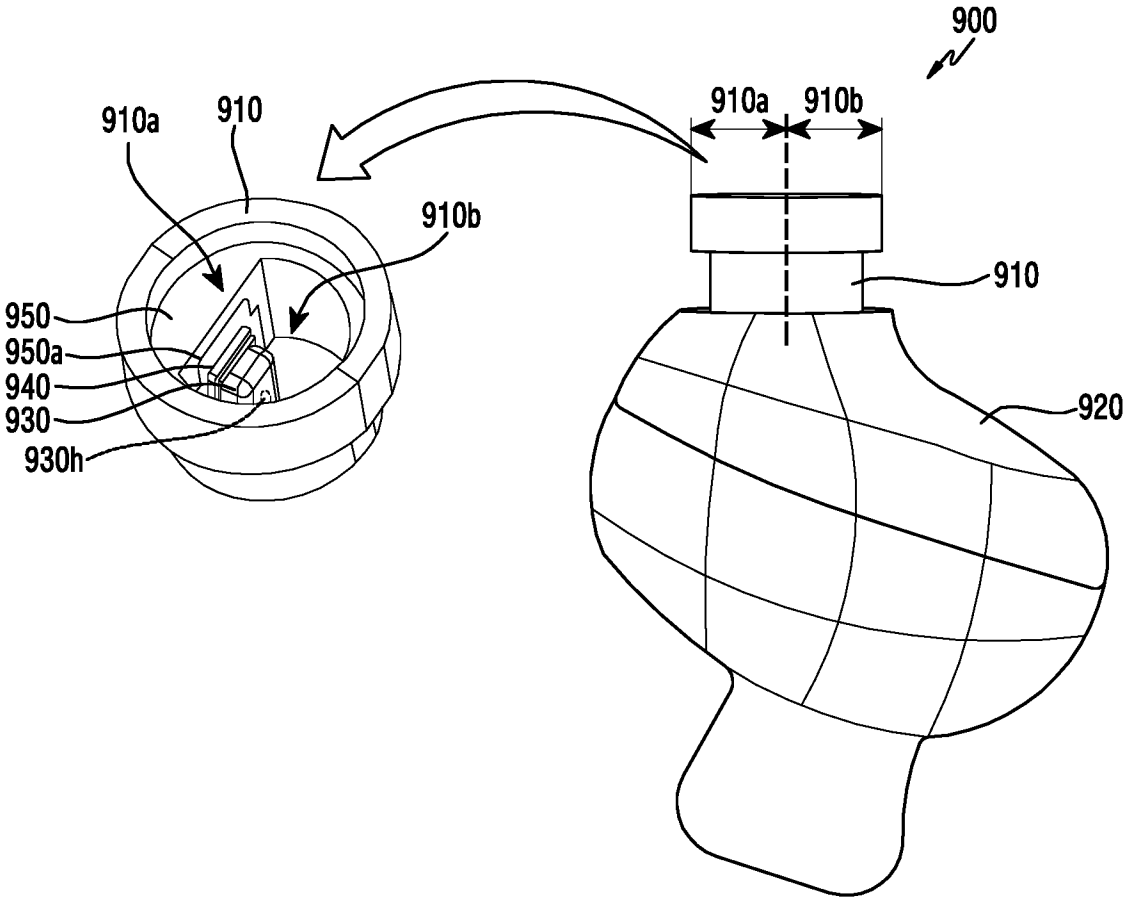
FIG. 9A is a side view and detailed perspective view illustrating a wearable acoustic device according to an embodiment of the present disclosure.
Figure 10:
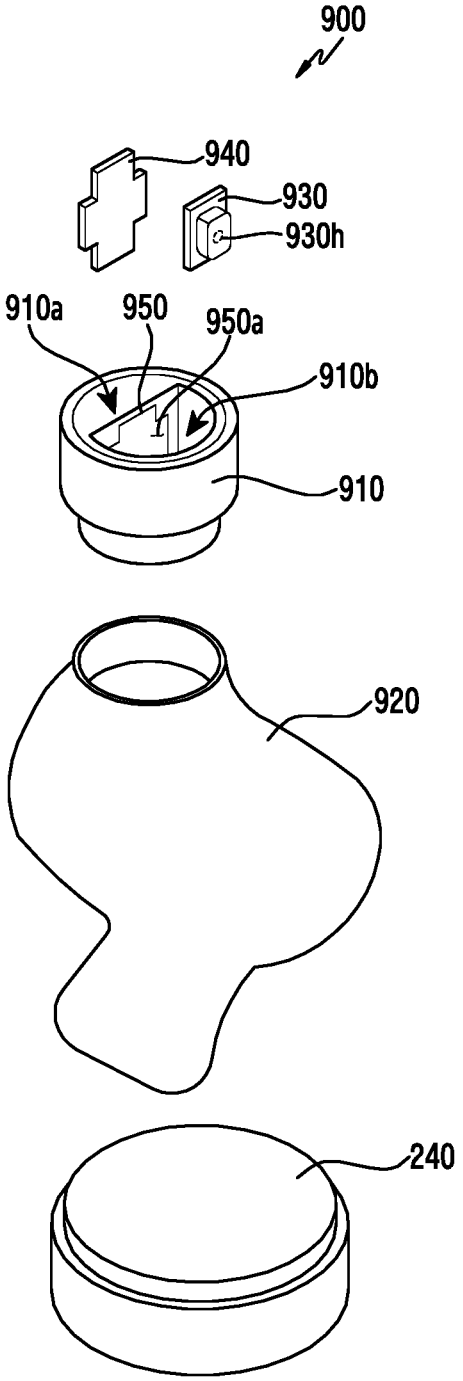
FIG. 10 is an exploded perspective view illustrating a wearable acoustic device according to an embodiment of the present disclosure.

FIG. 9A is a side view and detailed perspective view illustrating a wearable acoustic device according to an embodiment of the present disclosure. FIG. 9B is a plan view illustrating the wearable device according to an embodiment of the present disclosure. FIG. 10 is an exploded perspective view illustrating the wearable acoustic device according to an embodiment of the present disclosure.

Referring to FIG. 9 and FIG. 10, the wearable acoustic device 900 can include a microphone 930, a circuit substrate 940, a fixing part 950, a first housing 910, a second housing 920, and the acoustic component part 240.

The first housing 910 includes a microphone mounting part 910*a* and a first acoustic emission path 910*b*. The microphone 930 can be arranged adjacent to the first acoustic emission path 910*b* within the first housing 910. The microphone 930 can be, for example, a top type microphone in which a microphone hole 930*h* is provided in a top surface. The first housing 910 can include the fixing part 950. That is, the fixing part 950 can be provided in the microphone mounting part 910*a*. The fixing part 950 can be formed integrally with the first housing 910, and the fixing part 950 can be a part forming an inner surface of the first housing 910, rather than a separate component. The fixing part 950 can include a recess 950*a*. That is, the recess 950*a* is dented concavely to a constant depth in the fixing part 950.

Figure 11A:
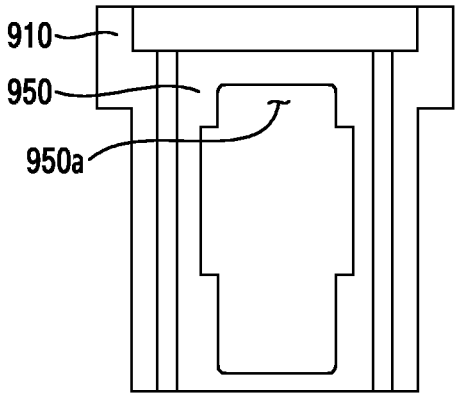
FIG. 11A is a plan view illustrating one surface of a first housing in a wearable acoustic device according to an embodiment of the present disclosure.
Figure 11B:
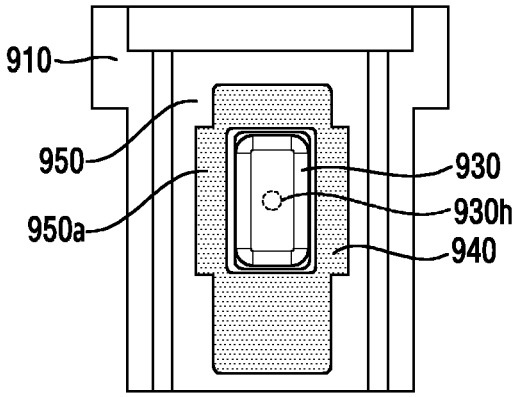
FIG. 11B is a plan view illustrating one surface of the first housing mounted with a microphone and a circuit substrate, in the wearable acoustic device according to an embodiment of the present disclosure.

FIG. 11A is a plan view illustrating one surface of a first housing in a wearable acoustic device according to an embodiment of the present disclosure. FIG. 11B is a plan view illustrating one surface of the first housing mounted with a microphone and a circuit substrate, in the wearable acoustic device according to an embodiment of the present disclosure.

Referring to FIG. 11, one surface of the first housing 910 can include the recess 950*a*. In detail, the fixing part 950 forming the one surface of the first housing 910 can include the recess 950*a*. The recess 950*a* can mount the circuit substrate 940. The recess 950*a* can be of a shape corresponding to the circuit substrate 940 such that the recess 950*a* can fix the circuit substrate 940. That is, the circuit substrate 940 can be inserted into the recess 950*a*. That is, the circuit substrate 940 mounted with the microphone 930 can be mounted in the recess 950*a*, and the circuit substrate 940 mounted with the microphone 930 can be fixed to the recess 950*a* by an adhesive layer as well. That is, the adhesive layer can be further provided between the circuit substrate 940 and the recess 950*a*. In particular, the adhesive layer can be a double-sided tape; however, the present disclosure is not limited to this, and the circuit substrate 940 can be fixed to the first housing 910 using a clip shaped fastener or other fastening device, so the circuit substrate 940 can be fitted and fixed to the first housing 910. The circuit substrate 940 can be detachable from the first housing 910.

Figure 12B:
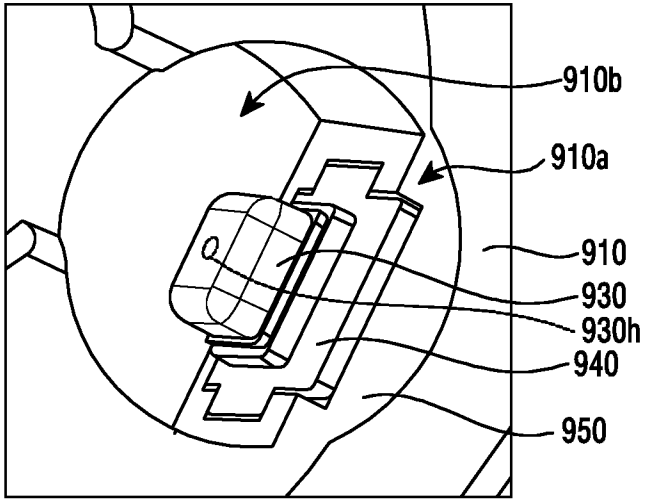
FIG. 12B is a perspective view illustrating a lower end at which the microphone and the circuit substrate are combined with the first housing.
Figure 12A:
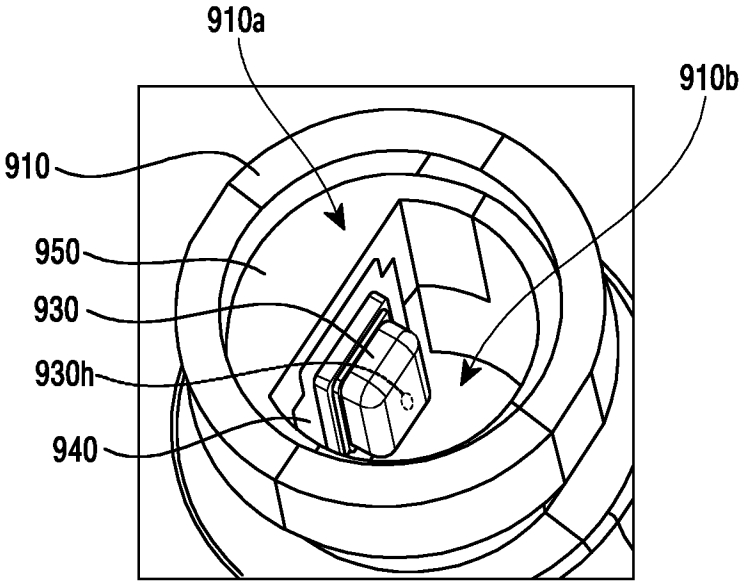
FIG. 12A is a side view and a perspective view illustrating an upper end at which a microphone and a circuit substrate are combined with a first housing.

FIG. 12A is a perspective view illustrating an upper end at which a microphone and a circuit substrate are combined with a first housing. FIG. 12B is a perspective view illustrating a lower end at which the microphone and the circuit substrate are combined with the first housing.

As illustrated in FIG. 12, a top surface of the microphone 930 can be arranged to face the first acoustic emission path 910*b*. The microphone 930 can be the top type microphone in which the microphone hole 930*h* is provided in the top surface. Accordingly, the microphone 930 can collect sound through the first acoustic emission path 910*b*.

Figure 13B:
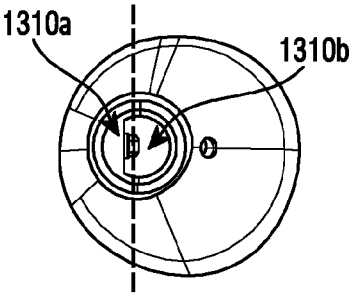
FIG. 13B is a plan view illustrating the wearable acoustic device according to an embodiment of the present disclosure.
Figure 13A:
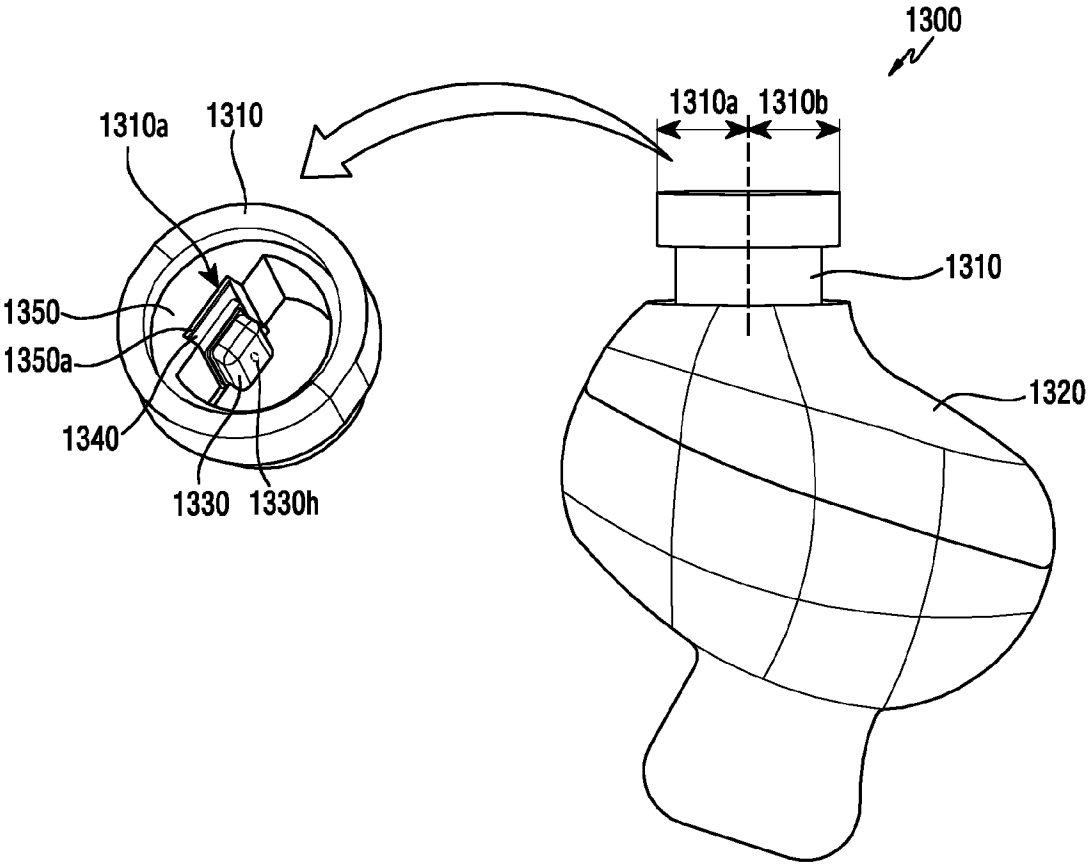
FIG. 13A is a side view and a perspective view illustrating a wearable acoustic device according to an embodiment of the present disclosure.

FIG. 13A is a side view and a perspective view illustrating a wearable acoustic device according to an embodiment of the present disclosure. FIG. 13B is a plan view illustrating the wearable acoustic device according to an embodiments of the present disclosure.

Referring to FIG. 13, the wearable acoustic device 1300 includes a microphone 1330, a circuit substrate 1340, a fixing part 1350, a first housing 1310, a second housing 1320, and an acoustic component part.

The first housing 1310 includes a microphone mounting part 1310*a* and a first acoustic emission path 1310*b*. The microphone 1330 can be arranged adjacent to the first acoustic emission path 1310*b* within the first housing 1310. The microphone 1330 can be, for example, a top type microphone in which a microphone hole 1330*h* is provided in a top surface. The first housing 1310 can include the fixing part 1350. That is, the fixing part 1350 can be provided in the microphone mounting part 1310*a*. The fixing part 1350 can be formed integrally with the first housing 1310. That is, the fixing part 1350 can be a part forming an inner surface of the first housing 1310, rather than a separate component. The fixing part 1350 can include a recess 1350*a*. The recess 1350*a* is dented concavely to a constant depth in the fixing part 1350.

Figure 14A:
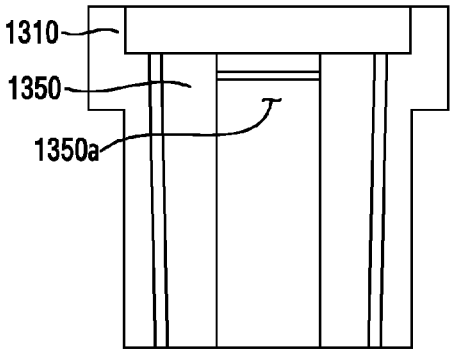
FIG. 14A is a plan view illustrating one surface of a first housing in a wearable acoustic device according to an embodiment of the present disclosure.
Figure 14B:
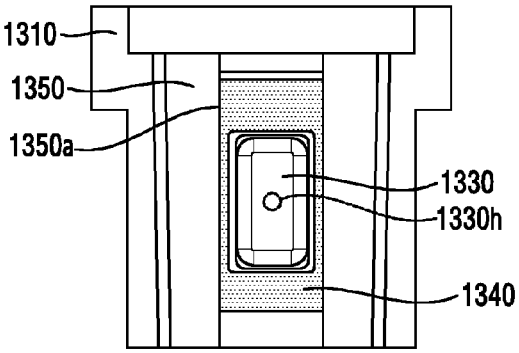
FIG. 14B is a plan view illustrating one surface of the first housing mounted with a microphone and a circuit substrate, in the wearable acoustic device according to an embodiment of the present disclosure.

FIG. 14A is a plan view illustrating one surface of a first housing in a wearable acoustic device according to an embodiment of the present disclosure. FIG. 14B is a plan view illustrating one surface of the first housing mounted with a microphone and a circuit substrate, in the wearable acoustic device according to an embodiment of the present disclosure.

Referring to FIG. 14, one surface of the first housing 1310 can include the recess 1350*a*. In detail, the fixing part 1350 forming one surface of the first housing 1310 can include the recess 1350*a*. The recess 1350*a* can mount the circuit substrate 1340. The recess 1350*a* can be of a shape corresponding to the circuit substrate 1340 such that the circuit substrate 1340 can be inserted into the recess 1350*a* to fix the circuit substrate 1340. That is, the circuit substrate 1340 mounted with the microphone 1330 can be mounted in the recess 1350*a*. The circuit substrate 1340 mounted with the microphone 1330 can be assembled into the recess 1350*a* in a slide fitting manner.

Figure 15B:
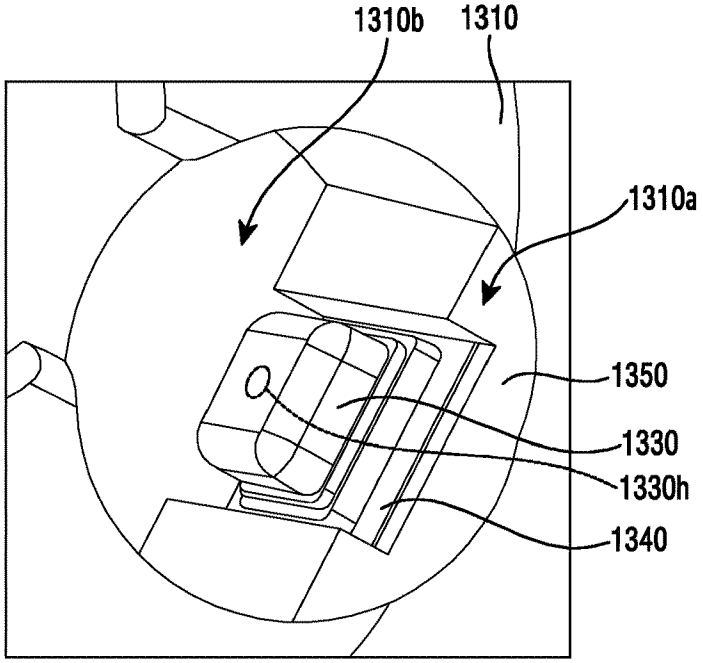
FIG. 15B is a perspective view illustrating a lower end at which the microphone and the circuit substrate are combined with the first housing.
Figure 15A:
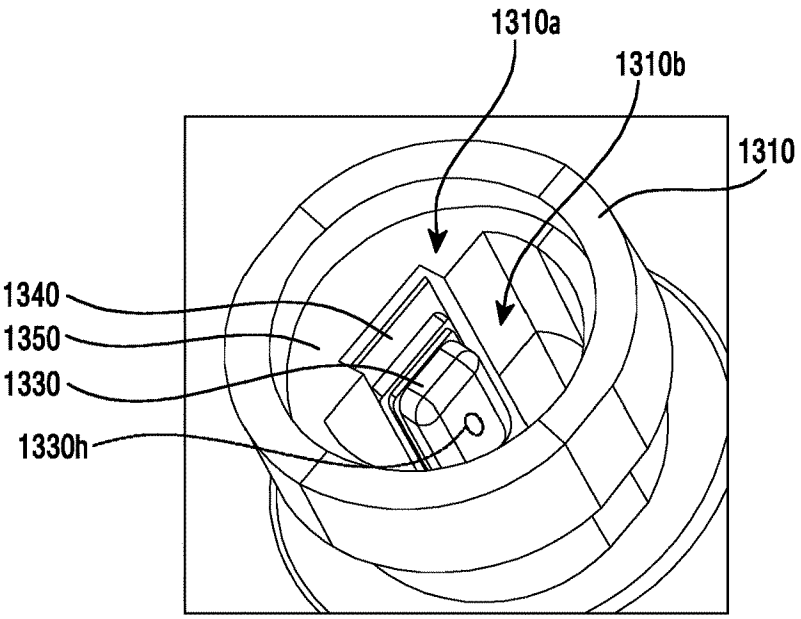
FIG. 15A is a perspective view illustrating an upper end at which a microphone and a circuit substrate are combined with a first housing.

FIG. 15A is a perspective view illustrating an upper end at which a microphone and a circuit substrate are combined with a first housing. FIG. 15B is a perspective view illustrating a lower end at which the microphone and the circuit substrate are combined with the first housing.

As illustrated in FIG. 15, a top surface of the microphone 1330 can be arranged to face the first acoustic emission path 1310*b*. The microphone 1330 can be a top type microphone in which the microphone hole 1330*h* is provided in the top surface. Accordingly, the microphone 1330 can collect sound through the first acoustic emission path 1310*b*.

Figure 16:
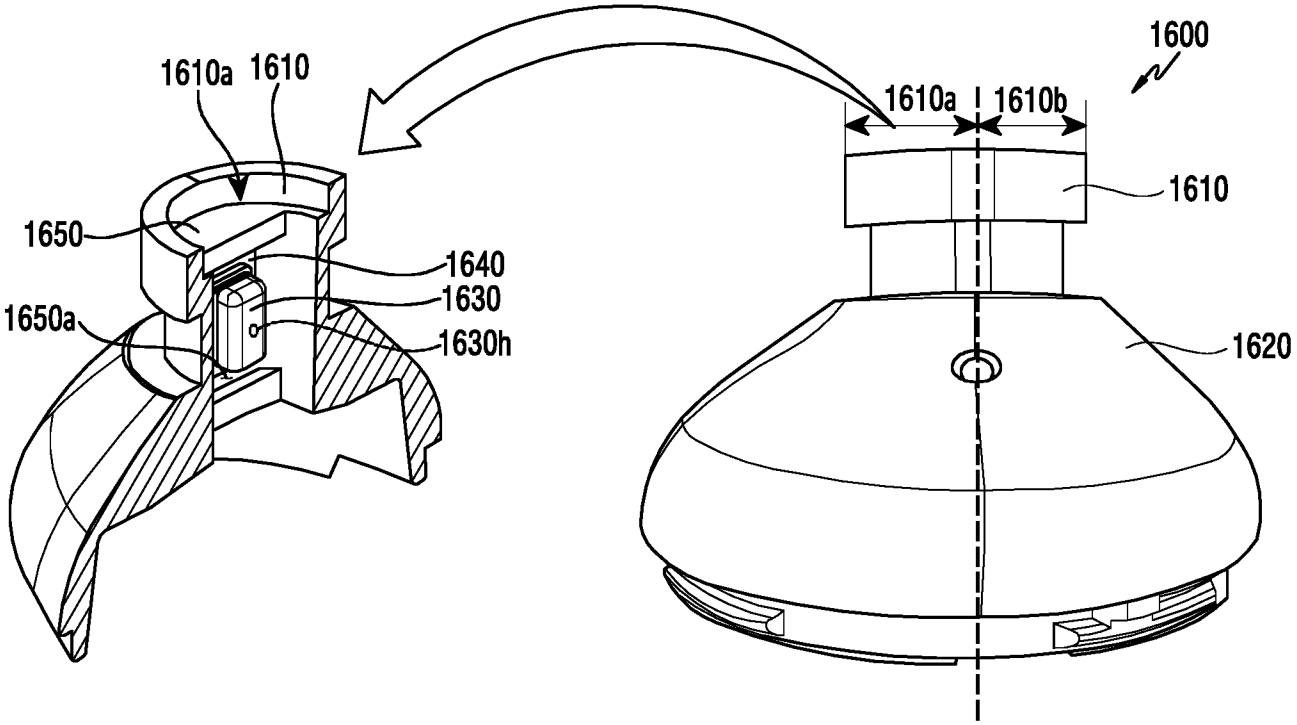
FIG. 16 is a perspective view illustrating a wearable acoustic device according to an embodiment of the present disclosure.

FIG. 16 is a perspective view illustrating a wearable acoustic device according to an embodiment of the present disclosure.

Referring to FIG. 16, the wearable acoustic device 1600 includes a microphone 1630, a circuit substrate 1640, a fixing part 1650, a first housing 1610, a second housing 1620, and an acoustic component part.

The first housing 1610 can include a microphone mounting part 1610*a* and a first acoustic emission path 1610*b*. The microphone 1630 can be arranged adjacent to the first acoustic emission path 1610*b* within the first housing 1610. The microphone 1630 can be, for example, a top type microphone in which a microphone hole 1630*h* is provided in a top surface. The first housing 1610 can include the fixing part 1650. That is, the fixing part 1650 can be provided in the microphone mounting part 1610*a*. The fixing part 1650 can be formed integrally with the first housing 1610. That is, the fixing part 1650 can be not a part forming an inner surface of the first housing 1610, rather than a separate component. The fixing part 1650 can include a recess 1650*a*, which is dented concavely to a constant depth in the fixing part 1650.

Figure 17A:
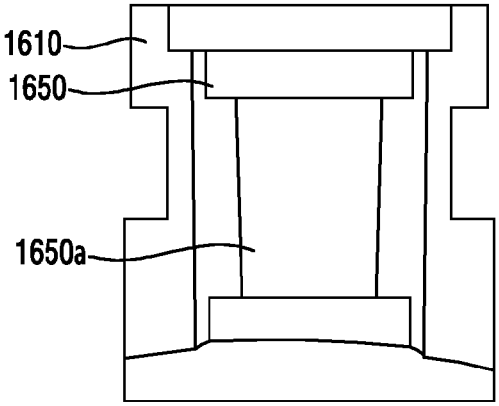
FIG. 17A is a plan view illustrating one surface of a first housing in a wearable acoustic device according to an embodiment of the present disclosure.
Figure 17B:
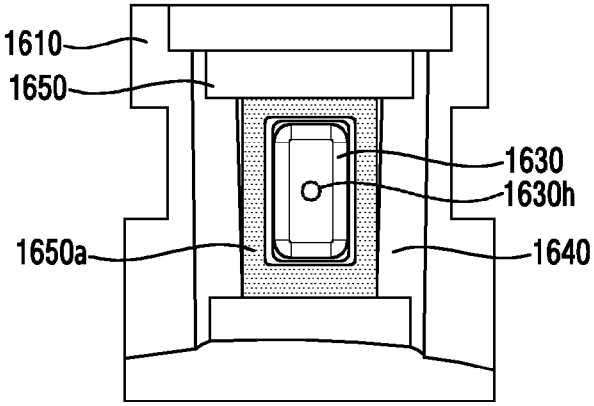
FIG. 17B is a plan view illustrating one surface of the first housing mounted with a microphone and a circuit substrate, in the wearable acoustic device according to an embodiment of the present disclosure.

FIG. 17A is a plan view illustrating one surface of a first housing in a wearable acoustic device according to an embodiment of the present disclosure. FIG. 17B is a plan view illustrating one surface of the first housing mounted with a microphone and a circuit substrate, in the wearable acoustic device according to an embodiment of the present disclosure.

Referring to FIG. 17, one surface of the first housing 1610 can include the recess 1650*a*. In detail, the fixing part 1650 forming one surface of the first housing 1610 can include the recess 1650*a*, which can mount the circuit substrate 1640. The recess 1650*a* can be of a shape corresponding to the circuit substrate 1640 such that the recess 1650*a* can fix the circuit substrate 1640, by inserting the circuit substrate 1640 into the recess 1650*a*. An upper end and lower end of the circuit substrate 1640 each can be inserted into the recess 1650*a*, so that the circuit substrate 1640 mounted with the microphone 1630 can be mounted in the recess 1650*a*. The circuit substrate 1640 mounted with the microphone 1630 can be assembled into the recess 1650*a* in a fitting manner.

Figure 18B:
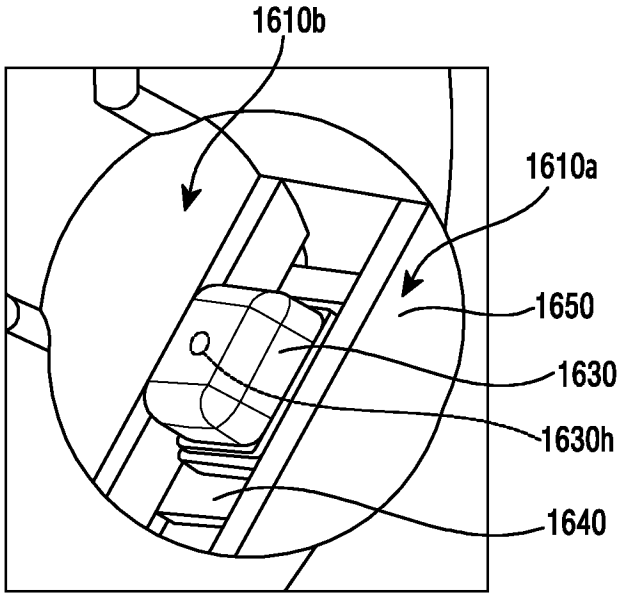
FIG. 18B is a perspective view illustrating a lower end at which the microphone and the circuit substrate are combined with the first housing.
Figure 18A:
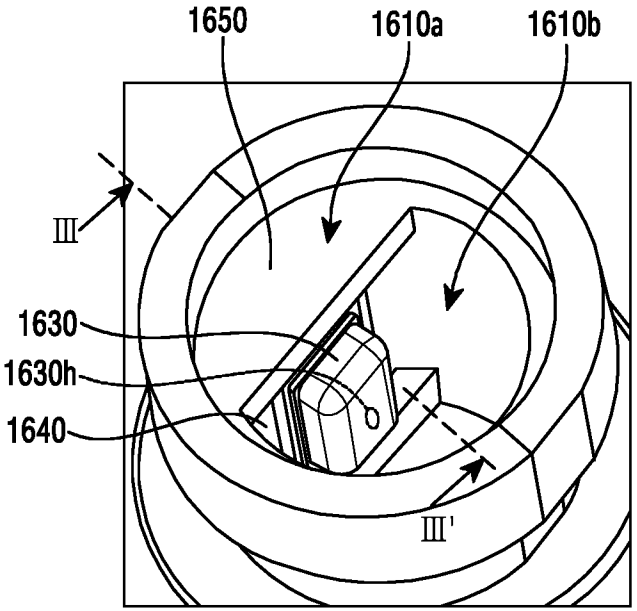
FIG. 18A is a perspective view illustrating an upper end at which a microphone and a circuit substrate are combined with a first housing.

FIG. 18A is a perspective view illustrating an upper end at which a microphone and a circuit substrate are combined with a first housing. FIG. 18B is a perspective view illustrating a lower end at which the microphone and the circuit substrate are combined with the first housing.

Referring to FIG. 18, a top surface of the microphone 1630 can be arranged to face the first acoustic emission path 1610*b*. The microphone 1630 can be a top type microphone in which the microphone hole 1630*h* is provided in a top surface.

Accordingly, the microphone 1630 can collect sound through the first acoustic emission path 1610*b*.

Figure 19A:
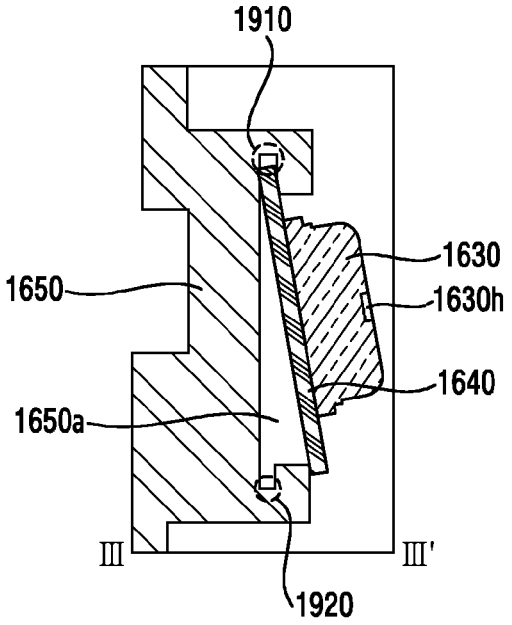
FIGS. 19A and FIG. 19B are sections taken along line III-III' of FIG. 18(*a*)
Figure 19B:
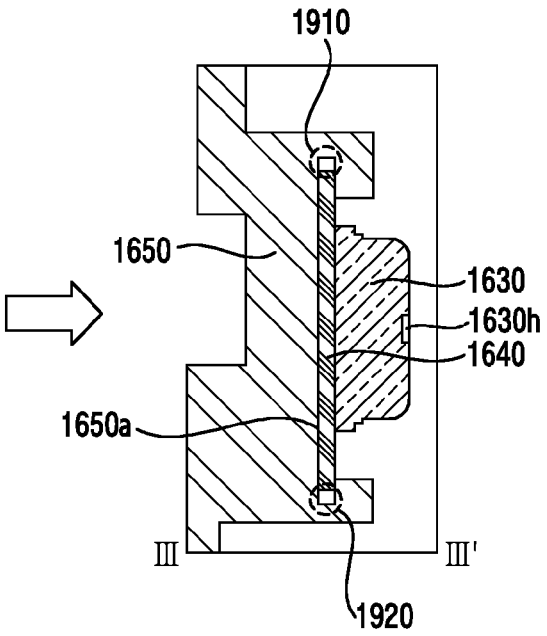

FIG. 19A and FIG. 19B are sections taken along line III-III' of FIG. 18A.

Referring to FIG. 19, the fixing part 1650 can include the recess 1650*a*. The recess 1650*a* can include a first recess 1910 and a second recess 1920. An upper end of the circuit substrate 1640 can be inserted into the first recess 1910. A lower end of the circuit substrate 1640 can be inserted into the second recess 1920. At this time, the upper end of the circuit substrate 1640 is first fitted into the first recess 1910 as illustrated in FIG. 19A and then, the lower end of the circuit substrate 1640 can be fitted and assembled into the second recess 1920 as illustrated in FIG. 19B.

Figure 20:
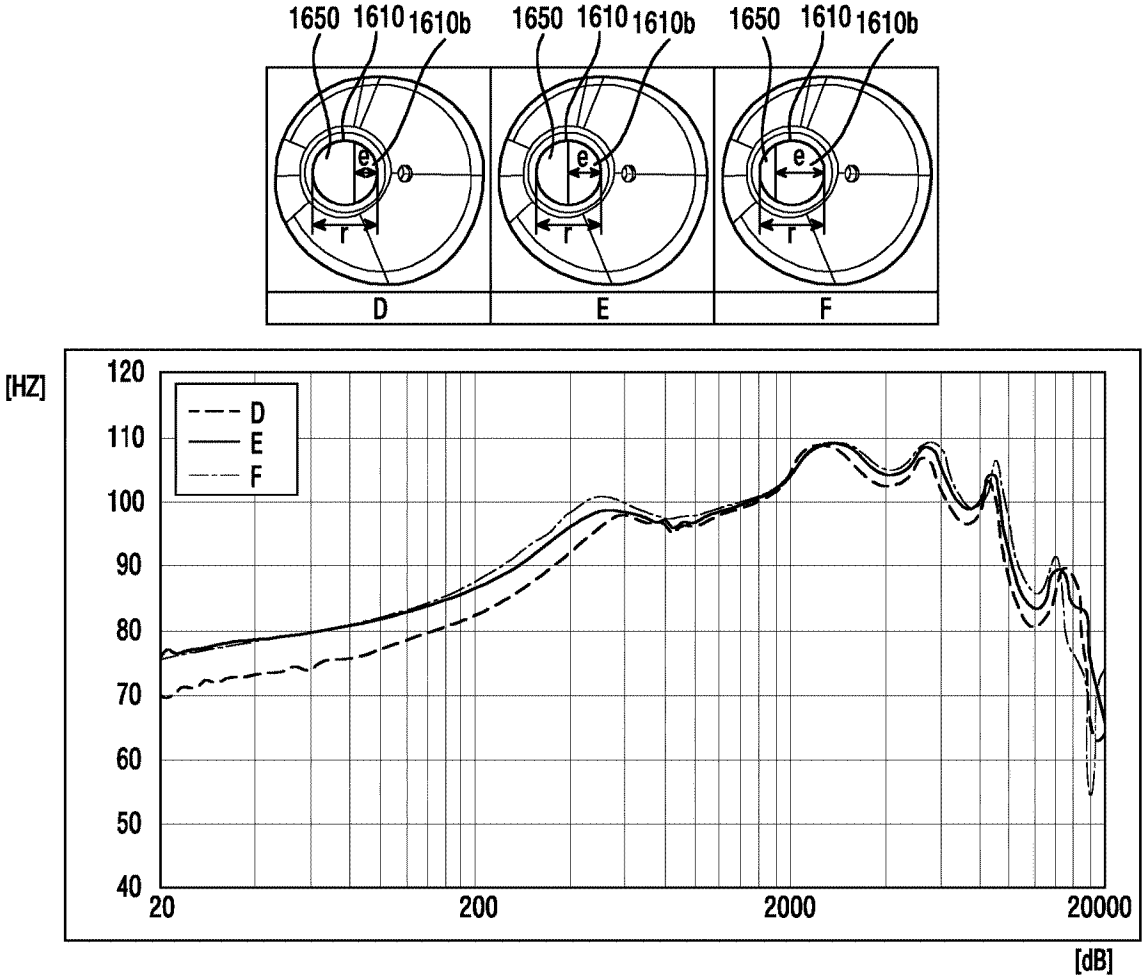
FIG. 20 is a graph representing acoustic performance dependent on a size of a first acoustic emission path in a wearable acoustic device according to an embodiment of the present disclosure.

FIG. 20 is a graph representing acoustic performance dependent on a size of a first acoustic emission path in a wearable acoustic device according to an embodiment of the present disclosure. FIG. 20 is a graph measuring a sound pressure level (SPL) in accordance with each embodiment.

Referring to FIG. 20, the first housing 1610 can include a first inner diameter (r), and the first acoustic emission path 1610*b* can include a second inner diameter (e). The second inner diameter (e) does not need to be a diameter of a circle, and can represent a distance between the fixing part 1650 and an inner surface of the first housing 1610 in the first acoustic emission path 1610*b*. In embodiment D, the first inner diameter (r) is 4 15 millimeters (mm), and the second inner diameter (e) is 1 mm In embodiment D, a size of the second inner diameter (e) can be 25% of a size of the first inner diameter (r). In embodiment E, the first inner diameter (r) is 4 mm, and the second inner diameter (e) is 2 mm In the embodiment D, the size of the second inner diameter (e) can be approximately 50% of the size of the first inner diameter (r). In embodiment F, the first inner diameter 20 (r) is approximately 4 mm, and the second inner diameter (e) is approximately 3 mm In embodiment D, the size of the second inner diameter (e) can be approximately 75% of the size of the first inner diameter (r).

As illustrated in FIG. 20, it can be determined that as the size of the first acoustic emission path 1610*b* increases, an acoustic characteristic or frequency characteristic improves. Where the size of the second inner diameter (e) is approximately 50% or more of the size of the first inner diameter (r) in the wearable acoustic device, an acoustic characteristic or frequency characteristic of a constant level can be secured.

A wearable acoustic device according to an embodiment of the present disclosure includes a first housing forming a first acoustic emission path, a second housing combined with the first housing in a first direction that is substantially parallel to the first acoustic emission path, and an acoustic component part arranged within the second housing, and emitting sound through the first acoustic emission path, and includes at least one microphone arranged adjacent to the first acoustic emission path within the first housing.

In the wearable acoustic device, the first housing can include a microphone mounting part mounting the microphone, the first acoustic emission path being adjacent to the microphone mounting part, and formed along the first direction.

In the wearable acoustic device, the microphone mounting part can further include a fixing part fixing the microphone, and the fixing part can be combined within the first housing.

In the wearable acoustic device, the fixing part can include at least one opening part.

In the wearable acoustic device, a circuit substrate electrically connected with the microphone can be further mounted in the microphone mounting part. And, the fixing part can include a first opening part that is arranged between the circuit substrate and the acoustic component part and is opened in the first direction.

In the wearable acoustic device, the fixing part can further include a second opening part that is arranged between the microphone and the first acoustic emission path and is opened in a second direction crossing with the first direction.

In the wearable acoustic device, the fixing part can further include a third opening part that is arranged in a position opposite the first opening part centering on the microphone and is opened in the first direction, and the first opening part and the third opening part can form a second acoustic emission path along the first direction.

In the wearable acoustic device, the microphone can be arranged to face the first acoustic emission path or the second acoustic emission path.

In the wearable acoustic device, the microphone, the circuit substrate, and the second opening part are arranged along the second direction.

In the wearable acoustic device, the acoustic component part can include a speaker.

In the wearable acoustic device, the first housing can include a first inner diameter. The first acoustic emission path can include a second diameter that is a distance between the fixing part and an inner surface of the first housing. The second diameter can be approximately 50% or more of the first inner diameter.

In the wearable acoustic device according to various exemplary embodiments of the present disclosure, the fixing part can be formed integrally with the first housing.

In the wearable acoustic device, the fixing part can include a recess, and at least a part of the circuit substrate can be arranged within the recess.

A wearable acoustic device includes a nozzle forming a first acoustic emission path, a housing combined with the nozzle in a first direction that is substantially parallel to the first acoustic emission path, a speaker arranged within the housing and emitting sound through the first acoustic emission path, and a microphone arranged adjacent to the first acoustic emission path within the housing.

In the wearable acoustic device, a hole of the microphone is arranged in a second direction crossing the first direction.

In the wearable acoustic device, the nozzle can further include a fixing part that fixes the microphone and a circuit substrate forwarding an electrical signal of the microphone.

In the wearable acoustic device, the microphone can include at least any one of an electronic condenser microphone (ECM) and a micro electro mechanical system (MEMS).

Various embodiments of the present disclosure can mount a microphone without an additional space in a wearable acoustic device worn on an ear. Also, where the mounted microphone is a microphone for noise cancellation, embodiments of the present disclosure can secure the acoustic performance of the wearable acoustic device.

Various embodiments of the present disclosure described above in the present specification and drawings are to only suggest specific examples so as to explain the technological content of the present disclosure and help the understanding of the present disclosure, and are not intended to limit the scope of the present disclosure. Accordingly, the scope of the present disclosure should be construed as including all modified or changes drawn on the basis of the technological spirit of the present disclosure, as defined by the appended claims and their equivalents.

What is claimed is:

1. A wearable acoustic device comprising:

a first housing forming a first acoustic emission path;

a second housing coupled to the first housing in a first direction that is substantially parallel with the first acoustic emission path;

an acoustic component part arranged within the second housing, and configured to emit sound through the first acoustic emission path;

at least one microphone arranged adjacent to the first acoustic emission path within the first housing; and a microphone mounting part arranged within the first housing and adjacent to the first acoustic emission path, wherein the microphone mounting part comprises a fixing part to fix the at least one microphone, and wherein the fixing part comprises a first opening part and a second opening part, arranged opposite to each other along the first direction.

2. The wearable acoustic device of claim 1, wherein a circuit substrate electrically connected with the at least one microphone is further mounted in the microphone mounting part, and the fixing part comprises the first opening part that is arranged between the circuit substrate and the acoustic component part and is opened in the first direction.

3. The wearable acoustic device of claim 2, wherein the fixing part further comprises a third opening part that is arranged between the at least one microphone and the first acoustic emission path and is opened in a second direction crossing with the first direction.

4. The wearable acoustic device of claim 1, wherein the first opening part and the second opening part form a second acoustic emission path along the first direction.

5. The wearable acoustic device of claim 4, wherein the at least one microphone is arranged to face the second acoustic emission path.

6. The wearable acoustic device of claim 3, wherein the at least one microphone, the circuit substrate, and the third opening part are arranged along the second direction.

7. The wearable acoustic device of claim 1, wherein the acoustic component part comprises a speaker.

8. The wearable acoustic device of claim 1, wherein the fixing part is formed integrally with the first housing.

9. The wearable acoustic device of claim 2, wherein the fixing part comprises a recess, and at least a part of the circuit substrate is arranged within the recess.

10. A wearable acoustic device comprising:

a nozzle forming a first acoustic emission path;

a housing coupled to the nozzle in a first direction that is substantially parallel to the first acoustic emission path;

a speaker arranged within the housing and configured to emit sound through the first acoustic emission path;

a microphone arranged adjacent to the first acoustic emission path within the housing; and a microphone mounting part arranged within the nozzle and adjacent to the first acoustic emission path, wherein the microphone mounting part comprises a fixing part to fix the microphone, and wherein the fixing part comprises a first opening part and a second opening part, arranged opposite to each other along the first direction.

11. The wearable acoustic device of claim 10, wherein a hole of the microphone is arranged in a second direction crossing the first direction.

12. The wearable acoustic device of claim 10, wherein a circuit substrate forwards an electrical signal of the microphone.

13. The wearable acoustic device of claim 10, wherein the microphone comprises at least one of an electronic condenser microphone (ECM) and a micro electro mechanical system (MEMS).

* * * * *